US011715883B2

(12) United States Patent
Itami et al.

(10) Patent No.: US 11,715,883 B2
(45) Date of Patent: Aug. 1, 2023

(54) FREQUENCY SELECTIVE SURFACE

(71) Applicant: Nippon Telegraph and Telephone Corporation, Tokyo (JP)

(72) Inventors: Go Itami, Tokyo (JP); Yohei Toriumi, Tokyo (JP); Jun Kato, Tokyo (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 235 days.

(21) Appl. No.: 17/414,475

(22) PCT Filed: Dec. 11, 2019

(86) PCT No.: PCT/JP2019/048427

§ 371 (c)(1),
(2) Date: Jun. 16, 2021

(87) PCT Pub. No.: WO2020/137540

PCT Pub. Date: Jul. 2, 2020

(65) Prior Publication Data

US 2022/0077590 A1 Mar. 10, 2022

(30) Foreign Application Priority Data

Dec. 25, 2018 (JP) ..... 2018-240590

(51) Int. Cl.
*H01Q 15/02* (2006.01)
*H01Q 15/14* (2006.01)

(52) U.S. Cl.
CPC ..... *H01Q 15/14* (2013.01)

(58) Field of Classification Search
CPC .... H01Q 15/14; H01Q 15/006; H01Q 15/008; H01Q 15/0013; H01Q 15/142; H01Q 15/145; H01Q 15/148
See application file for complete search history.

(56) References Cited

U.S. PATENT DOCUMENTS 5,917,458 A * 6/1999 Ho ..... H01Q 9/285 343/769
7,463,213 B2 * 12/2008 Nakano ..... H01Q 15/142 343/912

(Continued)

OTHER PUBLICATIONS

Makino, "(Tutorial Lecture) Basic Design Theory of Frequency Selective Reflector and its Applications," IEICE, Technical Report, 2015, 115(12):17-24, 17 pages (with English Translation).

(Continued)

*Primary Examiner* — Tho G Phan
(74) *Attorney, Agent, or Firm* — Fish & Richardson P.C.

(57) ABSTRACT

To provide a frequency selective surface of which an operating frequency and a bandwidth thereof can be readily adjusted. A frequency selective surface structured such that resonators $k_{xy}$ formed by conductive patterns with a same shape are periodically arranged on a dielectric substrate, wherein the resonator $k_{xy}$ includes: a conductor wire part with a lateral pattern 10 and a longitudinal pattern 20 which form a cross above a dielectric substrate 101; and an electrode plate part created by extending, in directions in which the lateral pattern and the longitudinal pattern are orthogonal to each other, respective both end parts of the lateral pattern and the longitudinal pattern having been extended by a prescribed length, the electrode plate part being shaped such that a tip portion thereof opposes a tip portion extended from another direction at an interval above a diagonal line, and the electrode plate part is shaped such that a central portion opposing an electrode plate part of another adjacent resonator is notched in a width of the lateral pattern, the electrode plate part being joined with the electrode plate part of the other adjacent resonator by being extended from a center of the notched portion in a width that is narrower than the width of the lateral pattern 10 and in a length that is shorter than the prescribed length, and the (Continued)

interval of the tip portion is wider than an interval with the electrode plate part of the other adjacent resonator.

4 Claims, 13 Drawing Sheets

(56) References Cited

U.S. PATENT DOCUMENTS

| | | | | |
|---|---|---|---|---|
| 7,639,206 | B2 * | 12/2009 | Behdad | H01Q 21/064 333/202 |
| 8,786,507 | B2 * | 7/2014 | Ayatollahi | H01Q 1/38 455/575.1 |
| 10,116,059 | B2 * | 10/2018 | Kim | H01Q 15/14 |
| 10,490,897 | B1 * | 11/2019 | Grandfield | H01Q 1/48 |
| 11,133,588 | B1 * | 9/2021 | Matos | H01Q 3/46 |
| 11,616,299 | B2 * | 3/2023 | Gómez-Diaz | H01Q 9/0457 343/703 |

OTHER PUBLICATIONS

Munk, "Element Types: A Comparison," Frequency Selective Surfaces Theory and Design, Apr. 2000, pp. 52-53.

* cited by examiner (a)

(b)

THICKNESS t: 1.3 μm , p: 10mm
l : 6.8mm , d: 0.2mm
g : 0.8mm , w: 1.5mm
$w_2$ : 0.2mm , $c_x$: 1.5mm
$c_y$ : 1.0mm , h: 1.5mm (a)

(b)

(a)

(b)

FREQUENCY SELECTIVE SURFACE

CROSS-REFERENCE TO RELATED APPLICATIONS

This application is a National Stage application under 35 U.S.C. § 371 of International Application No. PCT/JP2019/048427, having an International Filing Date of Dec. 11, 2019, which claims priority to Japanese Application Serial No. 2018-240590, filed on Dec. 25, 2018. The disclosure of the prior application is considered part of the disclosure of this application, and is incorporated in its entirety into this application.

TECHNICAL FIELD

The present invention relates to a frequency selective surface with a structure in which resonators of a same shape are periodically arranged on a dielectric substrate.

BACKGROUND ART

Reduced sizes and increased functionality of information communication devices have led to a rapid proliferation of wireless communication services that use lines such as a wireless LAN and LTE. Accordingly, transmission and reception of radio waves by wireless communication terminals are being performed more frequently over a wider area, which is a concern in terms of effects of the radio waves on other electronic devices in the periphery.

Conceivable effects of concern include degradation of a wireless environment, communication failure, and threat to security. A technique for suppressing such effects is required.

Frequency selective surfaces (FSS) can be used for the purpose of controlling a radio wave environment and an electromagnetic environment. Frequency selective surfaces impart frequency dependency to transmission characteristics/reflection characteristics of incident electromagnetic waves by periodically arranging resonators (unit cells) formed by conductor patterns of which dimensions are approximately equal to or smaller than a wavelength.

Frequency selective surfaces include resonance structures with various frequency characteristics. For example, most of frequency selective surfaces having band-stop filter characteristics which only reflect specific frequencies are configured such that a conductor part has a resonance structure, and examples thereof include a ring type, a dipole array type, a tri-hole type, a patch type, and a Jerusalem cross type (NPL 1).

Frequency selective surfaces have a large number of structural parameters to be taken into consideration and, some cases, parameters have a conflicting relationship with increases and decreases in an inductance component and a capacitance component. In addition, characteristics also change depending on how the unit cells are arranged, which all combine to make the underlying theory complicated (NPL 2).

CITATION LIST

Non Patent Literature

[NPL 1] Shigeru Makino, "[Tutorial lecture] Basic Design Theory of Frequency Selective Reflector and its Applications", Shingakugiho, A P 2015-5, Apl. 2015

[NPL 2] BEN A. MUNK, "Frequency Selective Surfaces Theory and Design", 2000.

SUMMARY OF THE INVENTION

Technical Problem

Since the theory is complicated, it is difficult to obtain desired frequency characteristics in one attempt. Therefore, designing frequency selective surfaces has a problem of being cost and labor intensive.

The present invention has been made in consideration of the problem described above and an object thereof is to provide a frequency selective surface of which an operating frequency and a bandwidth can be readily adjusted.

Means for Solving the Problem

A frequency selective surface according to an aspect of the present invention is a frequency selective surface structured such that resonators formed by conductive patterns with a same shape are periodically arranged on a dielectric substrate, wherein the resonator includes: a conductor wire part with a lateral pattern and a longitudinal pattern which form a cross above the dielectric substrate; and an electrode plate part created by extending, in directions in which the lateral pattern and the longitudinal pattern are orthogonal to each other, respective both end parts of the lateral pattern and the longitudinal pattern having been extended by a prescribed length, the electrode plate part being shaped such that an extended tip portion opposes a tip portion extended from another direction at an interval above a diagonal line, wherein the electrode plate part is shaped such that a central portion opposing an electrode plate part of another adjacent resonator is notched in a width of the lateral pattern, the electrode plate part being joined with the electrode plate part of the other adjacent resonator by being extended from a center of the notched portion in a width that is narrower than the width of the lateral pattern and in a length that is shorter than the prescribed length, and the interval of the tip portion is wider than an interval with the electrode plate part of the other adjacent resonator.

Effects of the Invention

According to the present invention, a frequency selective surface of which an operating frequency and a bandwidth thereof can be readily adjusted can be provided.

DESCRIPTION OF EMBODIMENTS

Hereinafter, embodiments of the present invention will be described with reference to the drawings. Same elements in a plurality of drawings will be denoted by same reference signs and descriptions will not be repeated.

First Embodiment

Figure 1:
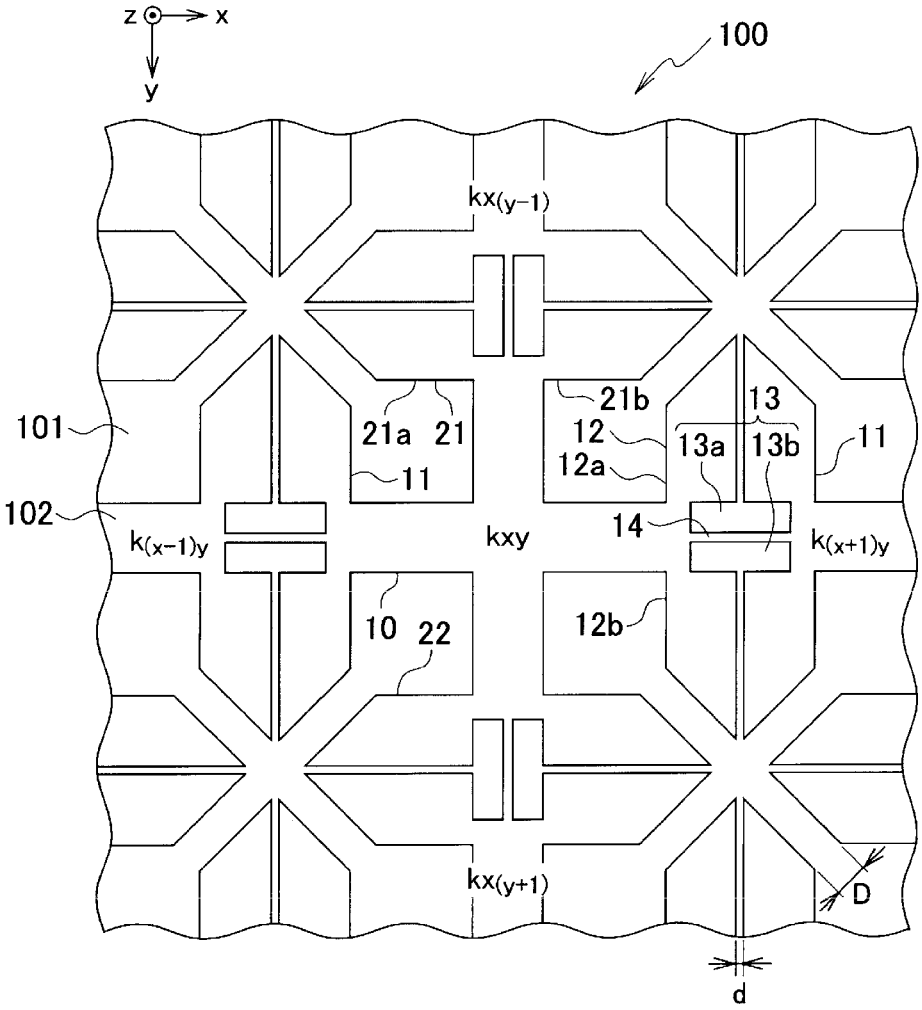
FIG. 1 is a diagram showing a partial plane of a frequency selective surface according to a first embodiment of the present invention.

FIG. 1 is a diagram schematically showing a partial plane of a frequency selective surface according to a first embodiment of the present invention. A frequency selective surface 100 shown in FIG. 1 is configured by periodically arranging resonators $k_{xy}$ formed by a conductive pattern with a shape similar to a two-by-two matrix on a dielectric substrate 101. In FIG. 1, an x direction will be defined as being lateral and a y direction as being longitudinal.

For example, the dielectric substrate 101 is constituted of a glass epoxy board, a polyimide film board, or the like. The dielectric substrate 101 may be made of any material as long as the material is a dielectric material.

A conductive film 102 is formed on the dielectric substrate 101. The resonator $k_{xy}$ (the conductive pattern) having a prescribed shape may be formed on the dielectric substrate 101 by vapor deposition or the conductive film 102 may be formed over an entire surface of the dielectric substrate 101 and subsequently etched to form the resonator $k_{xy}$.

For example, 10 resonators $k_{xy}$ are respectively arranged in the x direction and the y direction to construct the frequency selective surface 100. A size of a single resonator $k_{xy}$ is around ⅓ of a wavelength of a resonance frequency.

A signal is input to the frequency selective surface 100 from a −z direction (a rear side) and output (transmitted) in a z direction (a front side). When an electromagnetic wave is input to the frequency selective surface 100, an electric field is created on an xy plane on which the resonator $k_{xy}$ is arranged and a current flows due to a resonance phenomenon.

A configuration of the resonator $k_{xy}$ will now be described on the basis of its relationship with a resonator $k_{(x+1)y}$ that is adjacent in a +x direction.

The resonator $k_{xy}$ includes a conductor wire part having a lateral pattern 10 and a longitudinal pattern 20 which form a cross above the dielectric substrate 101. Furthermore, respective both end parts in which the lateral pattern 10 and the longitudinal pattern 20 have been extended by a prescribed length are respectively extended (12*a*, 12*b*) in orthogonal directions. In addition, the resonator $k_{xy}$ includes an electrode plate part 12 that is shaped such that a tip portion thereof opposes a tip portion having been extended from another direction across an interval D on a diagonal line.

In addition, a central portion of the electrode plate part 12 which opposes an electrode plate part 11 of another adjacent resonator $k_{(x+1)y}$ is notched in a width of the lateral pattern 10 (a notched part 13). Furthermore, the electrode plate part 12 is extended from a center of the notched part 13 in a width that is narrower than the width of the lateral pattern 10 and in a length that is shorter than a length of the lateral pattern 10 to be joined with the electrode plate part 11 of the other adjacent resonator $k_{(x+1)y}$ (a conductor pattern 14). The interval D between tip portions of the conductor patterns 12*a* and 12*b* respectively extended in directions that are orthogonal to the lateral pattern 10 is a wider shape than an interval d with the electrode plate part 11 of the other adjacent resonator $k_{(x+1)y}$. In other words, a planar shape of the electrode plate part 12 is a trapezoid of which an outer side is a lower base and an inner side is an upper base, and a central portion of the lower base is notched. Furthermore, the electrode plate part 12 is shaped such that the conductor pattern 14 with a width that is narrower than the lateral pattern 10 is extended from a center of the notched part 13 in the y direction to be joined with the electrode plate part 11 of the other adjacent resonator $k_{(x+1)y}$. The notched part 13 is divided into two parts, namely, notched parts 13*a* and 13*b*, by the conductor pattern 14.

While the configuration of the resonator $k_{xy}$ has been described above on the basis of its relationship with the resonator $k_{(x+1)y}$ that is adjacent in the +x direction, the configuration is the same in a vertical direction (y) and a horizontal direction (x). In other words, each resonator $k_{xy}$ is vertically symmetrical about a central line of the lateral pattern 10. In addition, each resonator $k_{xy}$ is horizontally symmetrical about a central line of the longitudinal pattern 20.

According to the characteristic configuration of the resonator $k_{xy}$, the frequency selective surface 100 according to the present embodiment includes a resonance path along which three resonance currents flow.

Figure 2:
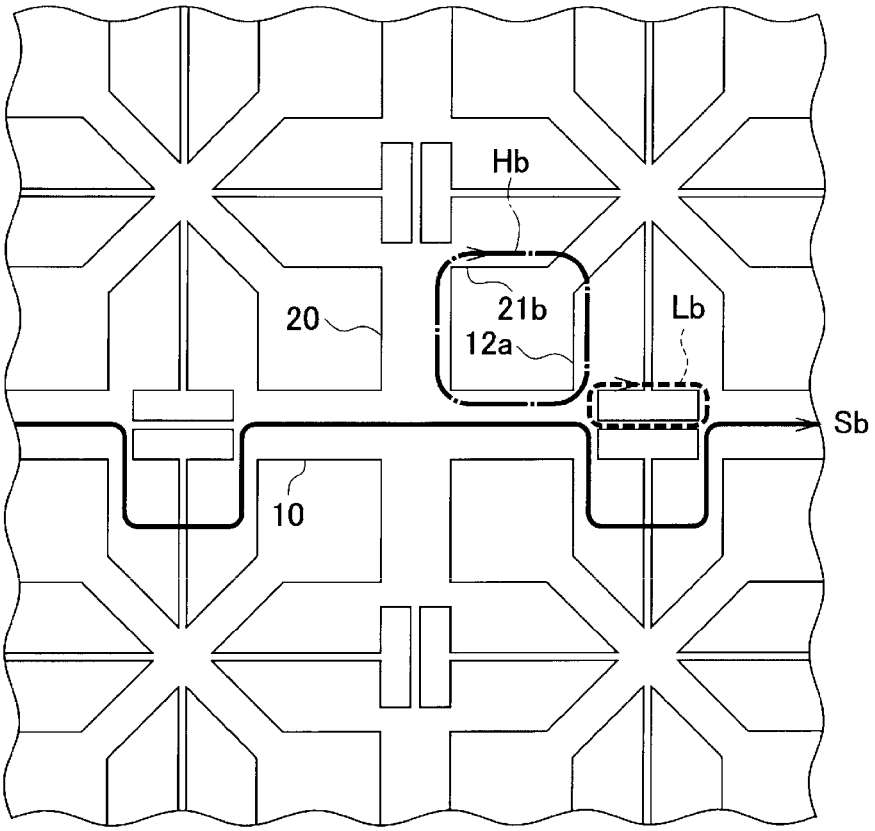
FIG. 2 is a diagram schematically showing a path along which a current corresponding to a plurality of resonance frequencies included in the frequency selective surface shown in FIG. 1 flows.

FIG. 2 is a diagram schematically showing a resonance path along which flow three resonance currents that flow through the frequency selective surface 100. The three resonance currents are: a stop band path Sb along which a resonance current of a cutoff frequency (operating frequency $f_{Sb}$) that is a series resonance frequency flows; a low frequency-side bandpass path Lb along which a resonance current of a low frequency-side parallel resonance frequency (a low frequency-side bandpass frequency $f_{Lb}$) flows; and a high frequency-side bandpass path Hb along which a resonance current of a high frequency-side parallel resonance frequency (a high frequency-side bandpass frequency $f_{Hb}$) flows.

The low frequency-side bandpass path Lb constitutes a low frequency-side bandpass resonator $k_{Lb}$. The high frequency-side bandpass path Hb constitutes a high frequency-side bandpass resonator $k_{Hb}$.

The stop band path Sb is a path that passes through lateral patterns 10 and longitudinal patterns 20 of adjacent resonators $k_{xy}$. In FIG. 2, only a path on a +y side of the x direction is shown in order to prevent the drawing from becoming complicated. The actual stop band path Sb symmetrically exists in the −y direction centered on the lateral pattern 10. In addition, the actual stop band path Sb also exists in ±x directions centered on the longitudinal pattern 20.

The low frequency-side bandpass path Lb is a path that circles around notched parts 13*a* of adjacent resonators $k_{xy}$. In FIG. 2, only a path on a +y side of the x direction is shown in a similar manner to the stop band path Sb. The actual low frequency-side bandpass path Lb symmetrically exists in the −y direction centered on the lateral pattern 10. In addition, the low frequency-side bandpass path Lb also exists in the ±x directions centered on the longitudinal pattern 20.

The high frequency-side bandpass path Hb is a path that circles around electrode plate parts 12*a* and 21*b* that cause tip portions of a single resonator $k_{xy}$ to oppose each other. Due to its vertically and horizontally symmetrical configuration, four high frequency-side bandpass paths Hb exist in a single resonator $k_{xy}$. In FIG. 2, only a path that circles around the electrode plate parts 12*a* and 21*b* is shown.

Figure 3:
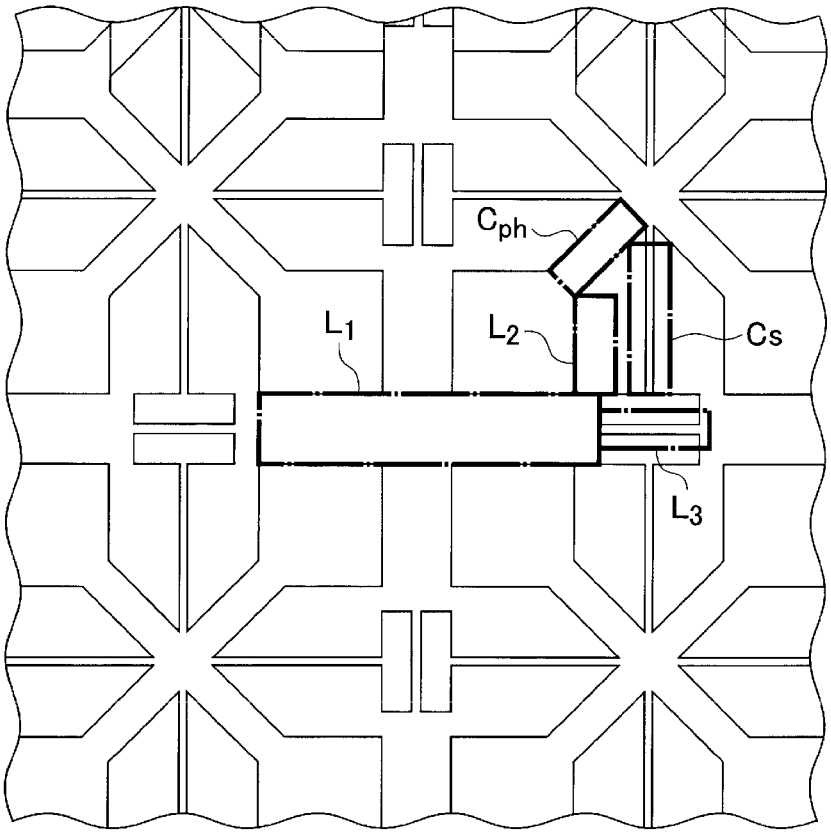
FIG. 3 is a diagram showing approximate positions and equivalent circuits of an induction component and a capacity component of the frequency selective surface shown in FIG. 1.
Figure 3:
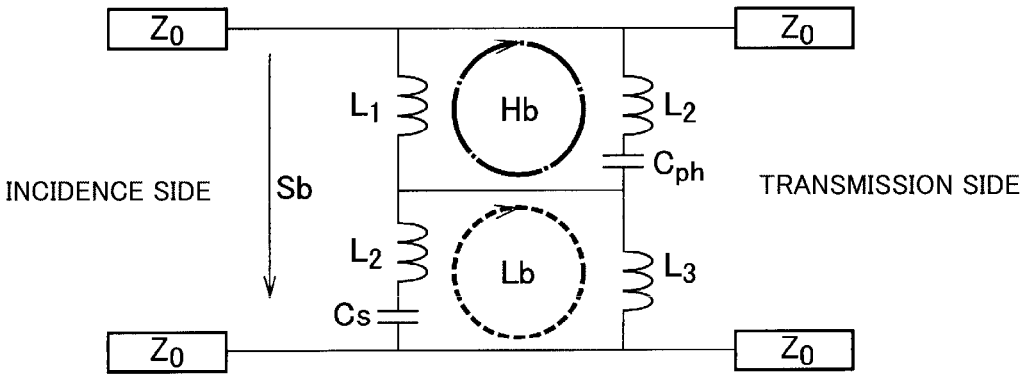

FIG. 3 is a diagram that schematically shows portions on the resonator $k_{xy}$ of an induction component and a capacity component which constitute each resonance path. The induction component is denoted by L and the capacity component is denoted by C.

FIG. 3(*a*) is a diagram in which approximate shapes of portions that constitute each component are enclosed by dashed lines. FIG. 3(*b*) is a diagram which shows each resonance path using an equivalent circuit.

The stop band path Sb can be expressed as a series connection of an induction component L1 that is formed by the lateral pattern 10 and the longitudinal pattern 20, an induction component L2 that is formed by the electrode plate part 12*a* in a direction orthogonal to the lateral pattern 10, and a capacity component $C_s$ that is formed between the electrode plate part 12*a* and the electrode plate part 11 of the adjacent resonator $k_{(x+1)y}$ (a path depicted by an arrow in FIG. 3(*b*)).

The low frequency-side bandpass path Lb can be expressed as a path created by connecting, in parallel, an induction component L3 that is formed by the conductor pattern 14 connecting the x direction of the notched part 13 to a series connection of the induction component L2 and the capacity component $C_s$ (a path depicted by a dashed-line circle in FIG. 3(*b*)).

The high frequency-side bandpass path Hb can be expressed as a path created by connecting, in parallel, a series connection of a capacity component $C_{ph}$ formed by tip portions of the conductor patterns 12*a* and 21*b* and the induction component L2 to the capacity component L1 (a path depicted by a dashed-dotted-line circle in FIG. 3(*b*)).

$Z_0$ shown in FIG. 3(*b*) represents space impedance. The space impedance $Z_0$ is an impedance that is determined by permittivity and permeability of vacuum.

A resonance frequency that is created on each path can be determined by parameters that represent a shape of the resonator $k_{xy}$. The parameters are, mainly, dimensions of respective parts that determine the shape of the resonator $k_{xy}$.

Figure 4:
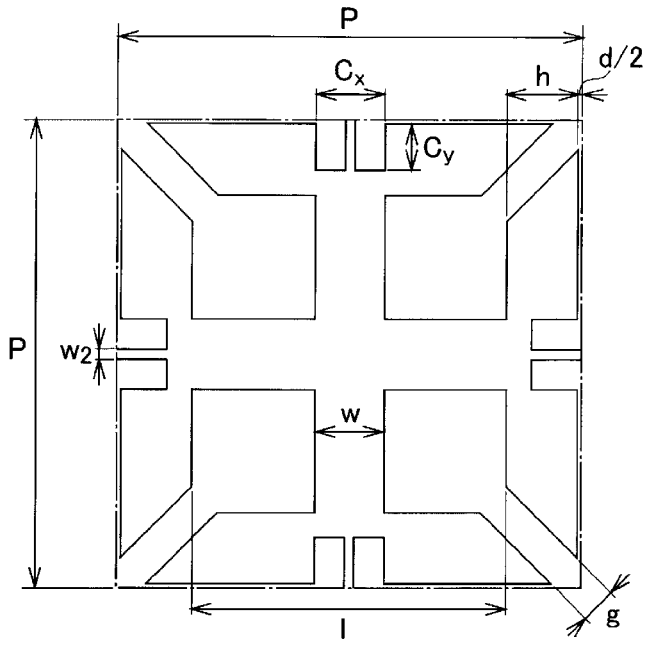
FIG. 4 is a diagram showing an example of parameters of a shape of the frequency selective surface shown in FIG. 1.

FIG. 4 is a diagram showing an example of the parameters that determine the shape of the resonator $k_{xy}$. A thickness of the conductive pattern is 1.3 μm. A pitch at which the resonator $k_{xy}$ is periodically arranged is set to 10 mm.

A length of the lateral pattern 10 and the longitudinal pattern 20 is denoted by l, a width of the lateral pattern 10 and the longitudinal pattern 20 is denoted by w, a length of the electrode plate part 12 in the x direction is denoted by h (a height of the trapezoidal shape), a width of the notched part is denoted by $c_x$, a depth of the notched part is denoted by $c_y$, a width of the conductive pattern 14 that bridges inside the notched part 13 is denoted by $w_2$, and a width of the interval D between tip portions of the electrode plate part is denoted by g.

Once these dimensions are determined, the shape of the resonator $k_{xy}$ including the length of the conductive pattern 14 is determined. In addition, by determining the shape of the resonator $k_{xy}$, values of the induction components L1 and L2 and the capacity components $C_s$ and $C_{ph}$ described above are determined.

Figure 5:
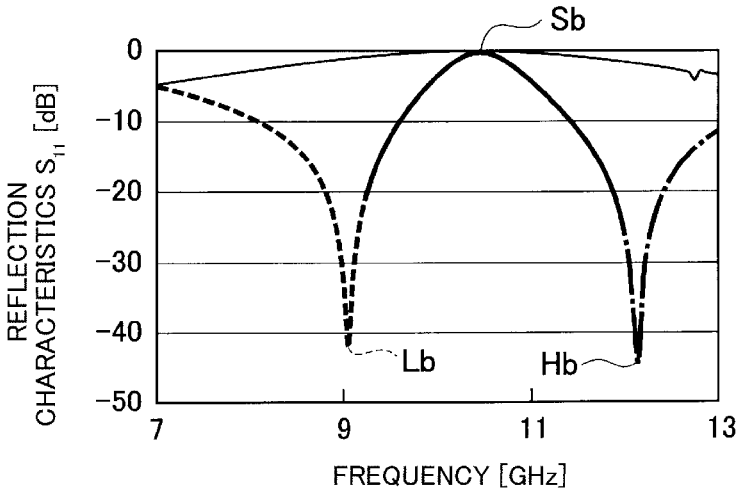
FIG. 5 is a diagram showing an example of frequency characteristics of the frequency selective surface shown in FIG. 1.

FIG. 5 shows an analysis result of a resonance frequency of the frequency selective surface shown in FIG. 4. An abscissa in FIG. 5 indicates frequency [GHz] and an ordinate in FIG. 5 indicates a reflection coefficient $S_{11}$ [dB] that represents reflection characteristics. Parameters of the analyzed resonator $k_{xy}$ are: l=6.8 mm, d=0.2 mm, g=0.8 mm, w=1.5 mm, $w_2$=0.2 mm, $c_x$=1.5 mm, $c_y$=1.0 mm, and h=1.5 mm.

As shown in FIG. 5, three resonance frequencies centered on the cutoff frequency $f_{Sb}$ and including the low frequency-side transmission frequency $f_{Lb}$ and the high frequency-side transmission frequency $f_{Hb}$ are obtained. Each resonance frequency is determined by respectively corresponding parameters.

The cutoff frequency $f_{Sb}$ is determined by the induction component L1 that is formed by the lateral pattern 10 and the longitudinal pattern 20, the induction component L2 that is formed by the electrode plate part 12*a* in a direction orthogonal to the lateral pattern 10, and the capacity component $C_s$ that is formed between the electrode plate part 12*a* and an electrode plate part 11*a* of the adjacent resonator $k_{(x+1)y}$. Therefore, among the parameters, the cutoff frequency $f_{Sb}$ is determined by the length l of the lateral pattern 10 and the longitudinal pattern 20, the width w of the lateral pattern 10 and the longitudinal pattern 20, the pitch p, and the interval d from the electrode plate part of another adjacent resonator.

Figure 6:
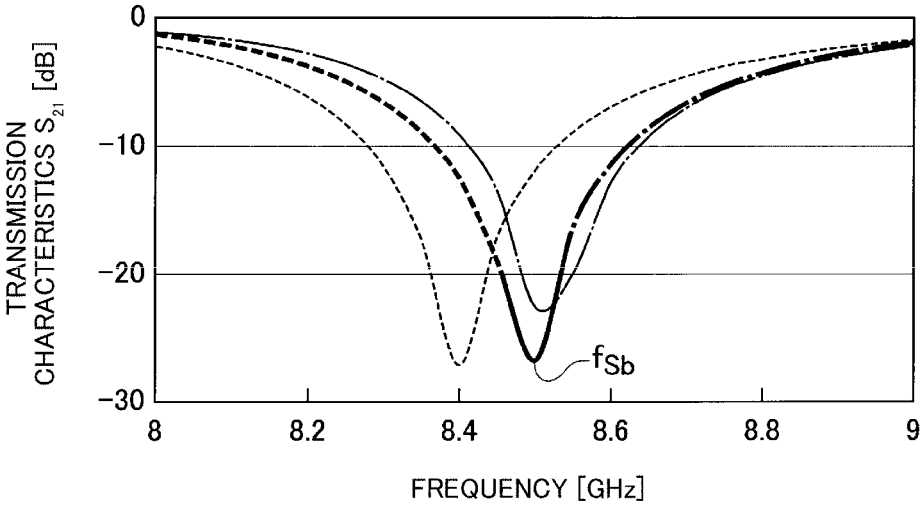
FIG. 6 is a diagram showing an example of a change in cutoff frequency due to a capacity component.

FIG. 6 is a diagram showing an example of a change in the cutoff frequency $f_{Sb}$ due to the capacity component $C_s$. An abscissa in FIG. 6 indicates frequency [GHz] and an ordinate in FIG. 6 indicates a transmission coefficient $S_{21}$ [dB] that represents transmission characteristics. A dashed line represents a case where the capacity component $C_s$ is increased and a dashed-dotted line represents a case where the capacity component $C_s$ is reduced. In this manner, the cutoff frequency $f_{Sb}$ can be changed according to the capacity component $C_s$.

The low frequency-side transmission frequency $f_{Lb}$ is determined by the induction component L3 due to the width $w_2$ of the conductive pattern 14 that bridges inside the notched part 13 and the pitch p, the induction component L2, and the capacity component $C_s$. The induction component L2 and the capacity component $C_s$ are also parameters that determine the cutoff frequency $f_{Sb}$. Therefore, the low frequency-side transmission frequency $f_{Lb}$ can be mainly controlled by the width $w_2$ of the conductive pattern 14.

The high frequency-side transmission frequency $f_{Hb}$ is determined by the capacity component $C_{ph}$ that is formed by tip portions of the conductor patterns 12*a* and 21*b* and the induction component L2. The induction component L2 is also the parameter that determines the cutoff frequency $f_{Sb}$. Therefore, the high frequency-side transmission frequency $f_{Hb}$ can be mainly controlled by the capacity component $C_{ph}$ that is formed by tip portions of the conductor patterns 12*a* and 21*b*.

As described above, each of the three resonance frequencies of a resonator can be controlled independently. In other words, an operating frequency and a bandwidth thereof can be readily adjusted.

As described above, the frequency selective surface 100 according to the present embodiment has a structure in which the resonators $k_{xy}$ formed by conductive patterns of a same shape are periodically arranged on the dielectric substrate 101. In the frequency selective surface 100, the resonator $k_{xy}$ includes a conductor wire part having a lateral pattern 10 and a longitudinal pattern 20 which form a cross above the dielectric substrate 101. Furthermore, in the frequency selective surface 100, respective both end parts in which the lateral pattern 10 and the longitudinal pattern 20 have been extended by a prescribed length are respectively extended in orthogonal directions. In addition, the resonator $k_{xy}$ includes the electrode plate part 12 that is shaped such that a tip portion thereof opposes a tip portion having been extended from another direction across an interval on a diagonal line. Furthermore, in the frequency selective surface 100, a central portion of the electrode plate part 12 which opposes the electrode plate part 11 of another adjacent resonator is notched in a width of the lateral pattern 10. In addition, the electrode plate part 12 is extended from a center of the notched portion 13 in a width that is narrower than the width of the lateral pattern 10 and in a length that is shorter than the prescribed length to be joined with the electrode plate part 11 of the other adjacent resonator. Furthermore, an interval D between tip portions of the electrode plate part is a wider shape than an interval d with the electrode plate part 11 of the other adjacent resonator. Accordingly, an operating frequency and a bandwidth thereof can be readily adjusted.

Since the frequency selective surface 100 according to the present embodiment includes the low frequency-side transmission frequency $f_{Lb}$ and the high frequency-side transmission frequency $f_{Hb}$ in addition to the central cutoff frequency $f_{Sb}$, bandwidths of cutoff characteristics (band-stop characteristics) can be made narrower by bringing the low frequency-side transmission frequency $f_{Lb}$ and the high frequency-side transmission frequency $f_{Hb}$ closer to the cutoff frequency $f_{Sb}$.

Second Embodiment

Figure 7:
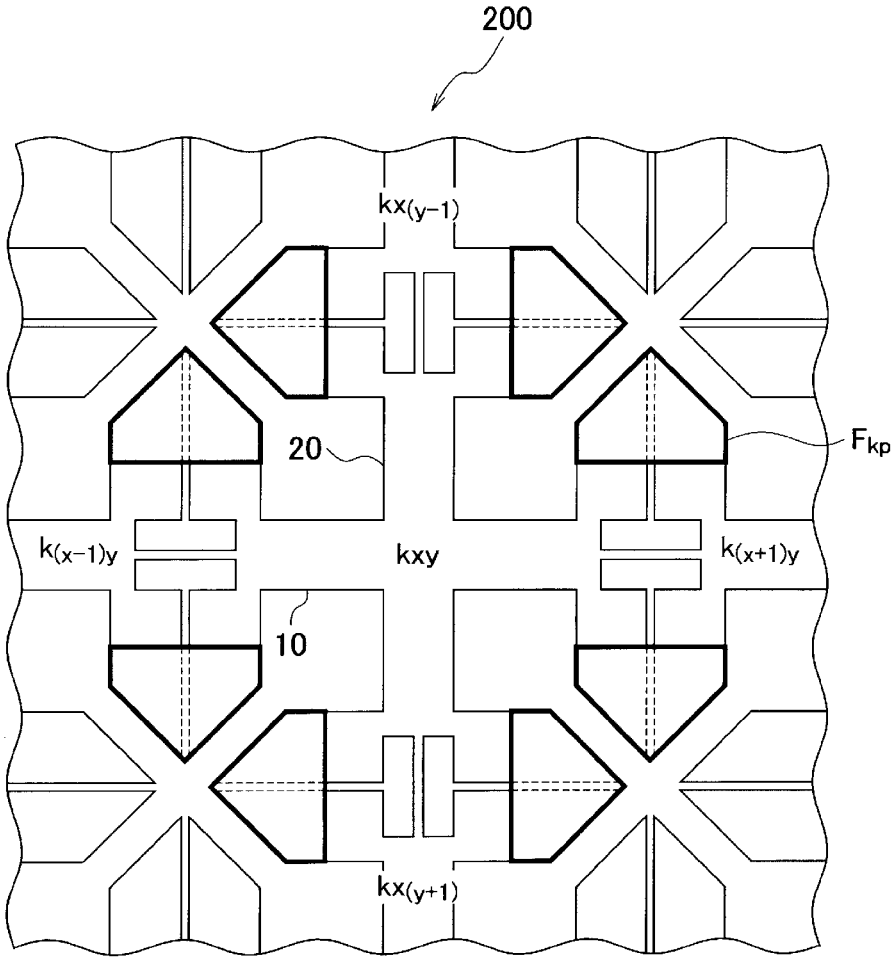
FIG. 7 is a diagram showing a partial plane of a frequency selective surface according to a second embodiment of the present invention.

FIG. 7 is a diagram schematically showing a plan view of a frequency selective surface according to a second embodiment of the present invention. A frequency selective surface 200 shown in FIG. 6 differs from the frequency selective surface 100 (FIG. 1) in including a sub-resonator.

The sub-resonator of the frequency selective surface 200 shown in FIG. 7 is constituted of a second conductive pattern $F_{kp}$ with, for example, a home base shape which covers tip portions of adjacent electrode plate parts 12*a* and 11*a*. The second conductive pattern $F_{kp}$ is also formed in tip portions of electrode plate parts 21 and 22 in the y direction.

The second conductive pattern $F_{kp}$ is formed by superposition while sandwiching the conductive film 102 of the electrode plate part 12*a* and the like and a dielectric layer. For example, conceivable methods of superimposing the conductive pattern $F_{kp}$ in layers include a method of superimposing and mounting two flexible boards or rigid boards on which the resonator $k_{xy}$ and the conductive pattern $F_{kp}$ are formed and a method of fixing two conductive patterns having been printed on a PET board in a state where conductive patterns are superimposed by lamination. Alternatively, the second conductive pattern $F_{kp}$ may be fabricated using a semiconductor process that forms a vapor-deposited film and a diffusion film.

Figure 8:
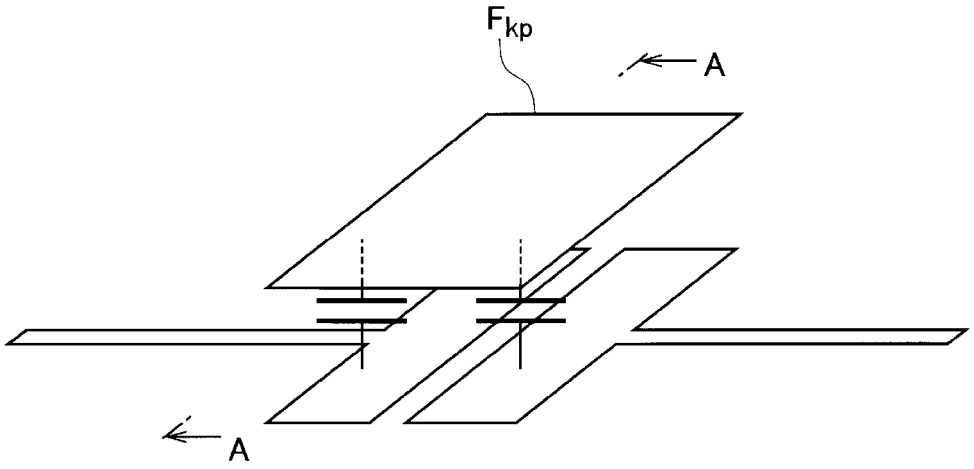
FIG. 8 is a diagram showing a capacity component that forms a sub-resonator of the frequency selective surface shown in FIG. 7.
Figure 8:
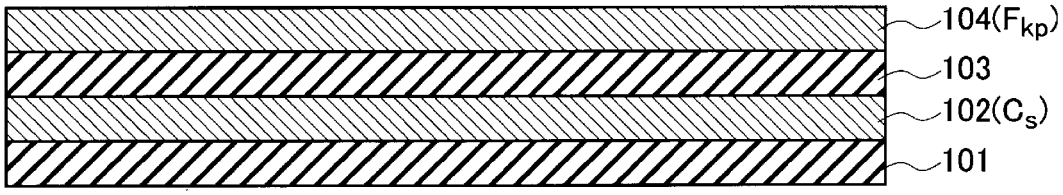

FIG. 8 is a diagram schematically showing a structure of the sub-resonator. FIG. 7(*a*) is a perspective view thereof. FIG. 8(*b*) is a sectional view cut along line A-A shown in FIG. 8(*a*).

As shown in FIG. 8(*a*), a series connection of two capacity components $C_s'$ is connected in parallel to the capacity component $C_s$ that is formed by adjacent electrode plate parts 12*a* and 11*a* by the conductive pattern $F_{kp}$ created by superposition by sandwiching a dielectric layer between the adjacent electrode plate parts 12*a* and 11*a*.

As shown in FIG. 8(*b*), the capacity component $C_s'$ is constituted of four layers, namely, the dielectric substrate 101, the conductive film 102, a dielectric film 103 and a second conductive pattern 104. Dielectric films and conductive films may be further increased. Details will be provided later.

Figure 9:
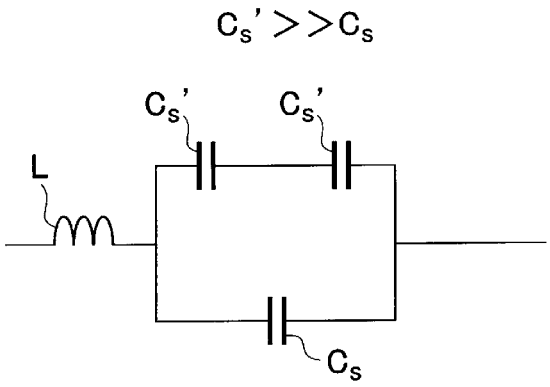
FIG. 9 is a diagram showing an equivalent circuit of the frequency selective surface shown in FIG. 7.

FIG. 9 is a diagram schematically showing an equivalent circuit of the frequency selective surface 200 including a sub-resonator. An equivalent circuit of the resonator $k_{xy}$ (hereinafter, sometimes referred to as a main resonator) that is formed by the conductive film 102 is expressed as a series connection of an induction component L and the capacity component $C_s$.

Therefore, the frequency selective surface 200 can be expressed as an equivalent circuit in which a series connection of two capacity components $C_s'$ is connected in parallel to the capacity component $C_s$ of the main resonator $k_{xy}$. A capacity formed between the second conductive pattern $F_{kp}$ and the electrode plate parts 12*a* and 11*a* is larger than the capacity component $C_s$ that is formed between the electrode plate parts 12*a* and 11*a* ($C_s' >> C_s$).

As is apparent from the equivalent circuit shown in FIG. 9, a cutoff frequency of the frequency selective surface 200 according to the present embodiment is a frequency to which the capacity component $C_s'$ has been added. Therefore, the cutoff frequency can be controlled by changing a shape of the second conductive pattern that forms the sub-resonator while keeping a shape of the main resonator $k_{xy}$ the same.

Figure 10:
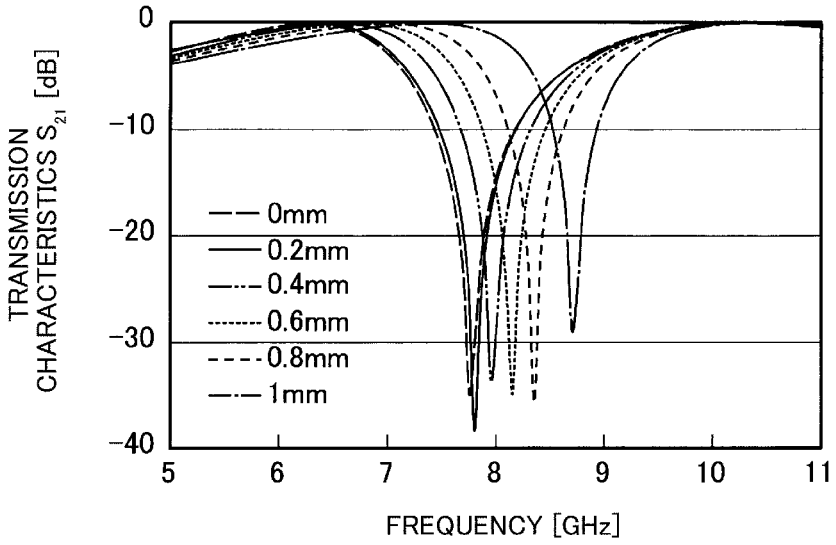
FIG. 10 is a diagram showing a change in cutoff frequency when changing a shape of a conductive pattern of the sub-resonator shown in FIG. 7.
Figure 10:
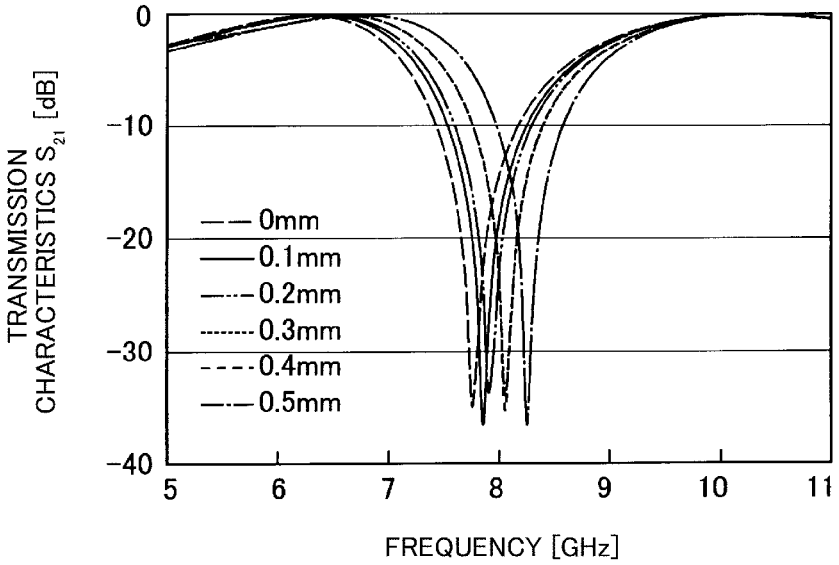

FIG. 10 is a diagram showing a change in cutoff frequency when changing a shape of the second conductive pattern $F_{kp}$.

FIG. 10(*a*) is a diagram showing a change when changing a length in the x direction and FIG. 10(*b*) is a diagram showing a change when changing a length in the y direction. An abscissa in FIG. 10 indicates frequency [GHz] and an ordinate in FIG. 10 indicates the transmission coefficient $S_{21}$ [dB] that represents transmission characteristics.

A parameter 0 mm in FIG. 10(*a*) represents a case of a shape of the second conductive pattern $F_{kp}$ shown in FIG. 6. A parameter 0.2 mm represents a change of −0.2 mm to the width of the second conductive pattern $F_{kp}$. Specifically, the characteristics represent a change of −0.1 mm from an outer side of one electrode plate part 12*a* and a change of −0.1 mm from an outer side of the other electrode plate part 11*a*.

As shown in FIG. 10(*a*), by changing the width of the second conductive pattern $F_{kp}$ within a range of 0 to 1 mm, the cutoff frequency can be made variable within a range of approximately 1 GHz. In other words, the cutoff frequency can be adjusted by changing the shape of the second conductive pattern $F_{kp}$ without changing the shape of the main resonator $k_{xy}$.

Parameters 0 mm to 0.5 mm in FIG. 10(*b*) represent dimensions by which the length of the second conductive pattern $F_{kp}$ in the y direction has been changed. The parameter 0 mm represents a case of the shape of the second conductive pattern $F_{kp}$ shown in FIG. 6.

As shown in FIG. 10(*b*), by changing the length of the second conductive pattern $F_{kp}$ in the y direction within a range of 0 to 0.5 mm, the cutoff frequency can be made variable within a range of approximately 0.5 GHz. In this manner, the cutoff frequency can also be adjusted by changing the length of the second conductive pattern $F_{kp}$ in the y direction.

As described above, the frequency selective surface 200 according to the present embodiment includes a second conductive pattern that is arranged on a conductor wire part so as to sandwich a dielectric film, and a planar shape of the second conductive pattern is a shape by which adjacent resonators cover a same portion and a shape which covers a space between electrode plate parts of a same resonator. Accordingly, the cutoff frequency of the main resonator $k_{xy}$ can be adjusted without changing the shape of the main resonator $k_{xy}$.

Third Embodiment

Figure 11:
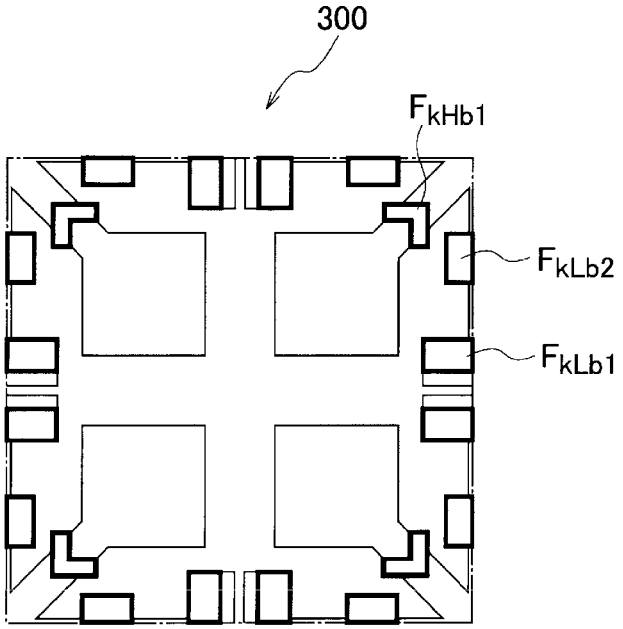
FIG. 11 is a diagram showing a partial plane of a frequency selective surface according to a third embodiment of the present invention.

FIG. 11 is a diagram schematically showing a plan view of a frequency selective surface according to a third embodiment of the present invention. A frequency selective surface 300 shown in FIG. 11 includes sub-resonators respectively corresponding to the low frequency-side bandpass resonator $k_{Lb}$ and the high frequency-side bandpass resonator $k_{Hb}$ with respect to the frequency selective surface 100 (FIG. 1).

In this example, the sub-resonator corresponding to the low frequency-side bandpass resonator $k_{Lb}$ is constituted of two second conductive patterns $F_{kLb1}$ and $F_{kLb2}$. The second conductive patterns $F_{kLb1}$ and $F_{kLb2}$ are formed by superposition while sandwiching the conductive film 102 of the electrode plate part 12*a* and the like and a dielectric layer in a similar manner to the second conductive pattern $F_{kp}$.

Each of the second conductive patterns $F_{kLb1}$ and $F_{kLb2}$ forms capacity components $C_{s1}'$ and $C_{s2}'$. The second conductive patterns $F_{kLb1}$ and $F_{kLb2}$ have a same shape that straddles adjacent resonators. In other words, respective shapes of the second conductive pattern $F_{kLb1}$ on the electrode plate 12*a* and on the electrode plate 11*a* are the same and are connected between adjacent resonators. The capacity components $C_{s1}'$ and $C_{s2}'$ operate by being connected in parallel to a parallel resonance frequency of the low frequency-side bandpass resonator $k_{Lb}$.

Figure 12:
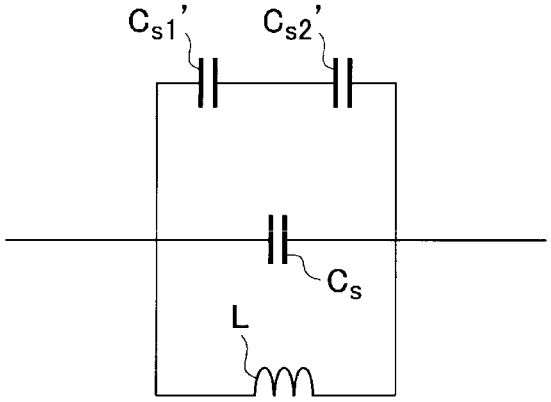
FIG. 12 shows an equivalent circuit in which a capacity component is connected in parallel to an equivalent circuit of a low frequency-side bandpass resonator.

FIG. 12 shows an equivalent circuit in which the capacity components $C_{s1}'$ and $C_{s2}'$ are connected in parallel to an equivalent circuit of the low frequency-side bandpass resonator $k_{Lb}$. As is apparent from the equivalent circuit, the low frequency-side transmission frequency $f_{Lb}$ of the frequency selective surface 300 according to the present embodiment is a frequency to which the capacity components $C_{s1}'$ and $C_{s2}'$ have been added. Therefore, the low frequency-side transmission frequency $f_{Lb}$ can be controlled by changing a shape of the second conductive pattern that forms the sub-resonator while keeping a shape of the low frequency-side bandpass resonator $k_{Lb}$ the same.

The second conductive pattern $F_{kHb1}$ forms the capacity component $C_{s1}'$ to be connected in parallel to an equivalent circuit of the high frequency-side bandpass resonator $k_{Hb}$. The high frequency-side transmission frequency $f_{Hb}$ can be controlled by the second conductive pattern $F_{kHb1}$. An effect thereof is the same as in the case of the low frequency-side transmission frequency $f_{Lb}$.

The low frequency-side bandpass resonator $k_{Lb}$ and the high frequency-side bandpass resonator $k_{Hb}$ can be respectively controlled independently. Therefore, a bandwidth of the cutoff frequency can be controlled by changing a shape of the second conductive patterns $F_{kLb1}$ and $F_{kLb2}$ that correspond to the low frequency-side bandpass resonator $k_{Lb}$ and a shape of the second conductive pattern $F_{kHb1}$ that corresponds to the high frequency-side bandpass resonator $k_{Hb}$.

Figure 13:
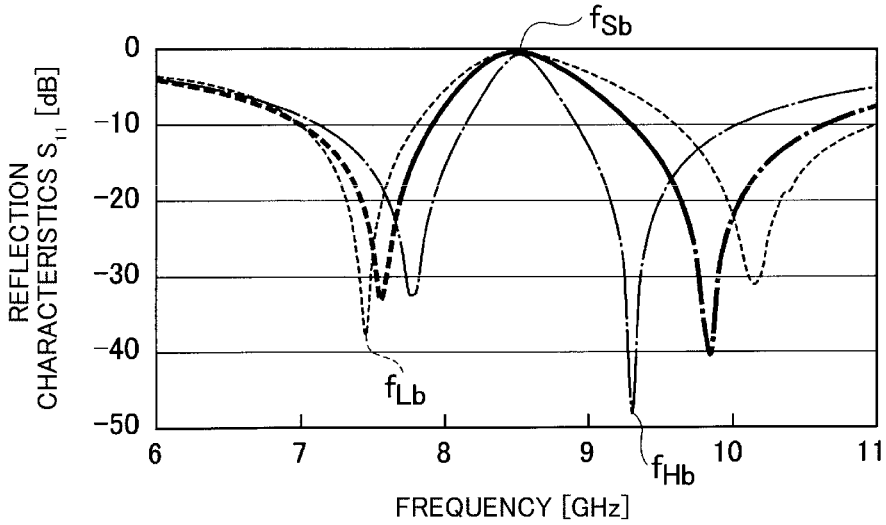
FIG. 13 is a diagram showing an example of reflection characteristics in a case of changing shapes of second conductive patterns that respectively constitute a sub-resonator corresponding to a low frequency-side bandpass resonator and a sub-resonator corresponding to a high frequency-side bandpass resonator.

FIG. 13 is a diagram showing an example of reflection characteristics in a case of changing shapes of second conductive patterns $F_{kLb1}$, $F_{kLb2}$, and $F_{kHb1}$ that respectively constitute a sub-resonator corresponding to the low frequency-side bandpass resonator $k_{Lb}$ and a sub-resonator corresponding to the high frequency-side bandpass resonator $k_{Hb}$ while keeping a shape of the main resonator $k_{xy}$ fixed.

An abscissa in FIG. 13 indicates frequency [GHz] and an ordinate in FIG. 13 indicates the reflection coefficient $S_{11}$ [dB] that represents reflection characteristics.

In FIG. 13, a dashed line depicts an example of characteristics when lowering the low frequency-side transmission frequency $f_{Lb}$ and raising the high frequency-side transmission frequency $f_{Hb}$. A dashed-dotted line depicts an example of characteristics when raising the low frequency-side transmission frequency $f_{Lb}$ and lowering the high frequency-side transmission frequency $f_{Hb}$. In this manner, the bandwidth of the frequency selective surface 300 can be controlled by changing shapes of the second conductive patterns $F_{kLb1}$, $F_{kLb2}$, and $F_{kHb1}$ that constitute sub-resonators that respectively correspond to the low frequency-side bandpass resonator $k_{Lb}$ and the high frequency-side bandpass resonator $k_{Hb}$.

It should be noted that the cutoff frequency has not changed significantly. In the example shown in FIG. 13, a change to the cutoff frequency is 3% or less. In this manner, the bandwidth can be made variable without changing the cutoff frequency.

While the second conductive patterns $F_{kLb1}$ and $F_{kLb2}$ and the second conductive pattern $F_{kHb1}$ have been described using an example in which all of the second conductive patterns are provided in a second conductive pattern, the second conductive patterns $F_{kLb1}$ and $F_{kLb2}$ and the second conductive pattern $F_{kHb1}$ may be provided in conductive patterns of different layers. For example, the second conductive pattern $F_{kHb1}$ may be formed by a third conductive pattern (not illustrated) that is arranged on the second conductive pattern $F_{kLb1}$ or the like so as to sandwich a dielectric film.

In addition, a third conductive pattern (not illustrated) with a same shape may be formed so as overlap with the second conductive patterns $F_{kLb1}$ and $F_{kLb2}$. The third conductive pattern with a same shape further enables a capacity component to be added in parallel to a parallel resonance circuit.

In addition, the second conductive pattern $F_{kHb1}$ having a hook shape in FIG. 11 may be formed by a third conductive pattern (not illustrated). Accordingly, a sub-resonator that acts on the high frequency-side bandpass resonator $k_{Hb}$ can be added.

As described above, the frequency selective surface 300 according to the third embodiment of the present invention includes a third conductive pattern that is arranged on a second conductive pattern so as to sandwich a dielectric film, and a planar shape of the third conductive pattern is a same shape as the second conductive pattern or a different shape from the second conductive pattern. Accordingly, a degree of freedom of design of the frequency selective surface 300 can be improved. In addition, since a larger capacity component with a same planar shape can be added, the frequency selective surface can be downsized.

It should be noted that a thickness of the dielectric film 103 (FIG. 8(*b*)) is a thickness in a range where a capacity component that is added by a second conductive pattern or a third conductive pattern can be handled with a lumped constant. For example, when a pitch at which the resonator $k_{xy}$ is periodically arranged on the dielectric substrate 101 is 10 mm, intervals between conductive patterns may be set to around 0.125 mm. Accordingly, propagation of electromagnetic waves resembling a transmission line in a thickness direction can be ignored and the frequency selective surfaces 200 and 300 can be readily designed.

As described above, with the frequency selective surface 100 according to the present embodiment, three resonance frequencies centered on a cutoff frequency $f_{Sb}$ and including a low frequency-side transmission frequency $f_{Lb}$ and a high frequency-side transmission frequency $f_{Hb}$ are obtained. Each resonance frequency is determined by respectively corresponding parameters. Therefore, a frequency selective surface of which an operating frequency and a bandwidth thereof can be readily adjusted can be provided.

In addition, the frequency selective surface 200 includes a sub-resonator corresponding to the main resonator $k_{xy}$. According to a conductive pattern constituting the sub-resonator, an operating frequency and a bandwidth thereof can be adjusted. The bandwidth of the cutoff frequency can be readily adjusted by adjusting the sub-resonator without changing the main resonator $k_{xy}$.

In addition, the frequency selective surface 300 includes sub-resonators respectively corresponding to the low frequency-side bandpass resonator $k_{Lb}$ and the high frequency-side bandpass resonator $k_{Hb}$. According to conductive patterns that constitute respectively corresponding sub-resonators, an operating frequency and a bandwidth thereof can be adjusted. Since the resonance frequency of the sub-resonators can be individually adjusted, an operating frequency and a bandwidth thereof can be readily adjusted.

It should be noted that the sub-resonator corresponding to the main resonator $k_{xy}$ and sub-resonators respectively corresponding to the low frequency-side bandpass resonator $k_{Lb}$ and the high frequency-side bandpass resonator $k_{Hb}$ can also be mounted on a same frequency selective surface. In addition, the planar shapes of the frequency selective surfaces respectively shown in FIGS. 1, 7, and 11 are merely examples and the shape of a conductive pattern is not limited thereto. For example, a width of the conductive pattern that is joined to an electrode plate part of another adjacent resonator may be narrower than the illustrated width or wider than the illustrated width. In this manner, it is obvious that the present invention includes various embodiments and the like not described in the present specification. Therefore, the technical scope of the present invention is to be determined solely by matters which are used to specify the invention in the scope of the following claims and which are appropriate in light of the above teachings.

REFERENCE SIGNS LIST

100, 200, 300 Frequency selective surface
103 Dielectric film
10 Lateral pattern (conductor wire part)
20 Longitudinal pattern (conductor wire part)
12, 12*a*, 12*b* Electrode plate part
13, 13*a*, 13*b* Notched part
14 Conductive pattern (conductive pattern that is joined to an electrode plate part of another adjacent resonator)
$k_{xy}$ Resonator (main resonator)
d Interval with electrode plate part of another adjacent resonator
D Interval across diagonal line of tip portion of electrode plate part
l Length of lateral pattern and longitudinal pattern
w Width of lateral pattern and longitudinal pattern
h Length of electrode plate part 12 in x direction (height of trapezoid)
$c_x$ Width of notched part
$c_y$ Depth of notched part
$w_2$ Width of conductive pattern that bridges inside of notched part
g Width of interval of tip portion of electrode plate part
$F_{kLb1}$, $F_{kLb2}$, $F_{kHb1}$ Second conductive pattern

The invention claimed is:

1. A frequency selective surface structured such that resonators formed by conductive patterns with a same shape are periodically arranged on a dielectric substrate, wherein a resonator comprises:

a conductor wire part comprising a lateral pattern and a longitudinal pattern, the lateral pattern and the longitudinal pattern form a cross above the dielectric substrate; and an electrode plate part, extended in directions in which the lateral pattern and the longitudinal pattern are orthogonal to each other, respective both end parts of the lateral pattern and the longitudinal pattern extended by a prescribed length, the electrode plate part is shaped such that an extended tip portion opposes a tip portion extended from another direction at an interval above a diagonal line, and the electrode plate part is shaped such that a central portion opposing an electrode plate part of another adjacent resonator is notched in a notched portion in a width of the lateral pattern, the electrode plate part is joined with the electrode plate part of the other adjacent resonator by extending from a center of the notched portion in a width that is narrower than the width of the lateral pattern and in a length that is shorter than the prescribed length, and the interval of the tip portion is wider than an interval with the electrode plate part of the other adjacent resonator.

2. The frequency selective surface according to claim 1, comprising a second conductive pattern that is arranged on the conductive pattern so as to sandwich a dielectric film, wherein a planar shape of the second conductive pattern is a shape which covers a same portion of adjacent resonators and a shape which covers a space between the electrode plate parts of a same resonator.

3. The frequency selective surface according to claim 2, comprising a third conductive pattern that is arranged on the second conductive pattern so as to sandwich the dielectric film, wherein a planar shape of the third conductive pattern is a same shape as the second conductive pattern or a different shape from the second conductive pattern.

4. The frequency selective surface according to claim 3, wherein a thickness of the dielectric film is a thickness in a range where a capacity component that is added by a second conductive pattern or a third conductive pattern is handled with a lumped constant.

* * * * *